US008011981B2

(12) United States Patent
Mizutani

(10) Patent No.: US 8,011,981 B2
(45) **Date of Patent: *Sep. 6, 2011**

(54) BOAT

(75) Inventor: Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 183 days.

This patent is subject to a terminal disclaimer.

(21) Appl. No.: 12/345,789

(22) Filed: Dec. 30, 2008

(65) Prior Publication Data

US 2009/0176418 A1 Jul. 9, 2009

(30) Foreign Application Priority Data

Jan. 8, 2008 (JP) ..... 2008-001135

(51) Int. Cl.
*B63H 21/22* (2006.01)
*B63H 23/00* (2006.01)

(52) U.S. Cl. ..... 440/1

(58) Field of Classification Search ..... 114/144 R, 114/144 RE; 440/53, 55, 58–60, 61 S, 1; 701/21

See application file for complete search history.

(56) References Cited

U.S. PATENT DOCUMENTS

| | | | | |
|---|---|---|---|---|
| 6,905,378 | B2 * | 6/2005 | Uraki et al. | 440/1 |
| 7,677,937 | B2 * | 3/2010 | Ishida et al. | 440/1 |
| 2002/0028613 | A1 * | 3/2002 | Matsuda et al. | 440/1 |
| 2010/0114412 | A1 * | 5/2010 | Mizutani | 701/21 |

FOREIGN PATENT DOCUMENTS

JP 2959044 B2 10/1999

* cited by examiner

*Primary Examiner* — Daniel Venne
(74) *Attorney, Agent, or Firm* — Keating & Bennett, LLP

(57) ABSTRACT

A boat includes a steering load detector arranged to calculate an output value of a steering motor necessary for steering an outboard motor in a traveling state, a motor output detector arranged to detect a possible output value that can be output by the steering motor, a prediction determination unit arranged to compare the necessary output value from the steering load detector with the possible output value from the motor output detector, and an electric power load control unit arranged to perform a control operation so as to increase a battery charge amount and/or to reduce the electric power load when the necessary output value is determined to be larger than the possible output value. As a result, the boat that can effectively perform steering when a motor output becomes small as a result of a reduced battery charge amount.

5 Claims, 5 Drawing Sheets

BOAT

BACKGROUND OF THE INVENTION

1. Field of the Invention

The present invention relates to a boat provided with an electric steering device that steers a boat propulsion unit of an outboard motor or the like by an electric signal supplied from an operator's seat.

2. Description of the Related Art

JP-B-2959044 discloses a conventional boat of this type. According to JP-B-2959044, a boat propulsion unit (outboard motor) provided with an engine and a propeller or the like for traveling is disposed on the outside of a hull, a steering motor for turning the outboard motor in the horizontal direction is disposed in a joint between the hull and the outboard motor, and the steering motor and a steering unit as a boat propulsion unit operation controller disposed in a steering motor and an operator's seat are connected by a signal cable (electric wire) that is capable of two way transmission of signals. A turning angle sensor is disposed in the steering unit, and the steering motor turns to steer the outboard motor based on a turning direction and a turning angle of the steering unit detected by the turning angle sensor.

However, in the invention described in JP-B-2959044, when a steering motor output to perform steering is smaller than a steering load due to a reduced battery charge amount, steering may not be able to be performed sufficiently. For this reason, it is hoped to achieve a control that can perform steering effectively.

In addition, in a boat in which a plurality of outboard motors are provided, steering loads on the right and left outboard motors are different at the time of turning. Also, a steering load changes depending on the boat on which the outboard motors are mounted and depending on a traveling condition. In the steering device for a boat in JP-B-2959044 or in other conventional steering devices for a boat, electric power is generated by each boat propulsion unit, and is supplied to a support device, a PTT (power trim and tilt device), an engine starter, a steering device, and so on. However, there maybe a response delay due to insufficient electric power for steering or a faulty engine start due to a reduced battery voltage under specific conditions such as a heavy load, a trim in condition, high speed traveling, and abrupt steering.

SUMMARY OF THE INVENTION

In view of the problems described above, preferred embodiments of the invention provide a boat that can perform steering efficiently even when the motor output becomes small due to a reduced battery charge amount.

According to a preferred embodiment of the present invention, a boat includes a boat propulsion unit arranged on a hull in a rotatable manner, a boat propulsion unit operation controller disposed in the hull and steered by an operator, a steering motor arranged to steer the boat propulsion unit based on steering control of the boat propulsion unit operation controller, a signal cable arranged to electrically connect the steering motor and the boat propulsion unit operation controller, a steering load detector arranged to calculate an output value of the steering motor necessary to steer the boat propulsion unit in a traveling state, a motor output detector arranged to detect a possible output value that can be output by the steering motor, a prediction determination unit arranged to compare the necessary output value from the steering load detector with the possible output value from the motor output detector, and an electric power load control unit arranged to control the battery charge amount to be increased and/or to control the electric power load to be reduced when the necessary output value is determined to be larger than the possible output value by the prediction determination unit.

Preferably, the steering load detector is arranged to calculate the necessary output value from at least either one of a traveling state, a steering state, a state of the boat propulsion unit, or the steering motor drive state.

The motor output detector preferably is arranged to detect the possible output value from either one of a battery voltage, a battery current, the steering motor temperature, the steering motor fault state, or the number of the boat propulsion units being driven.

The electric power load control unit is preferably arranged to control at least either one of the number of driven engines of the boat propulsion unit, driving of the trim, driving of an engine starter, engine rotational speed, the number of batteries that are connected, or the number of electric generators that are driven, and increases electric power to be supplied to the steering motor to be larger than a current state, so that the possible output value is increased.

The electric power load control unit is preferably arranged to reduce electric power load of electric apparatuses excluding electric power used for the steering control, and to increase electric power to be supplied to the steering motor to be larger than a current state, so that the possible output value is increased.

According to a preferred embodiment of the present invention, by comparing a necessary output value (steering load) detected by the steering load detector and a possible output value detected by the motor output detector, when a possible output value to perform steering becomes less than a steering load as a result of a reduced battery charge amount or the like, control is performed through the electric power load control unit, so that steering control can be effectively performed while continuously securing a propulsive force by maintaining a substantially constant motor output.

The steering load detector preferably calculates a necessary output value from at least either one of a traveling state, a steering state, a boat propulsion unit state, or a steering motor drive state, so that a steering load can be detected more accurately.

The motor output detector preferably detects a possible output value from at least either one of a battery voltage, a battery current, a steering motor temperature, a steering motor faulty state, or the number of the boat propulsion units that are driven, so that the motor output can be detected more accurately.

The electric power load control unit preferably controls at least either one of the number of driven engines of the boat propulsion unit, driving of the trim, driving of the engine starter, engine rotational speed, the number of batteries that are connected, or the number of electric generators that is driven, and also preferably controls the electric power supplied to the steering motor to be larger than a current state to increase a possible output value. Thus, steering control can be effectively performed while continuously securing a propulsive force by maintaining a substantially uniform motor output.

The electric power load control unit preferably performs control so as to reduce the electric power load of electric apparatuses excluding the electric power used for the steering control, and increase the electric power supplied to the steering motor to be larger than a current state in order to increase the possible output value. Thus, steering control can be effectively performed while continuously securing a propulsive force by maintaining a substantially uniform motor output.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
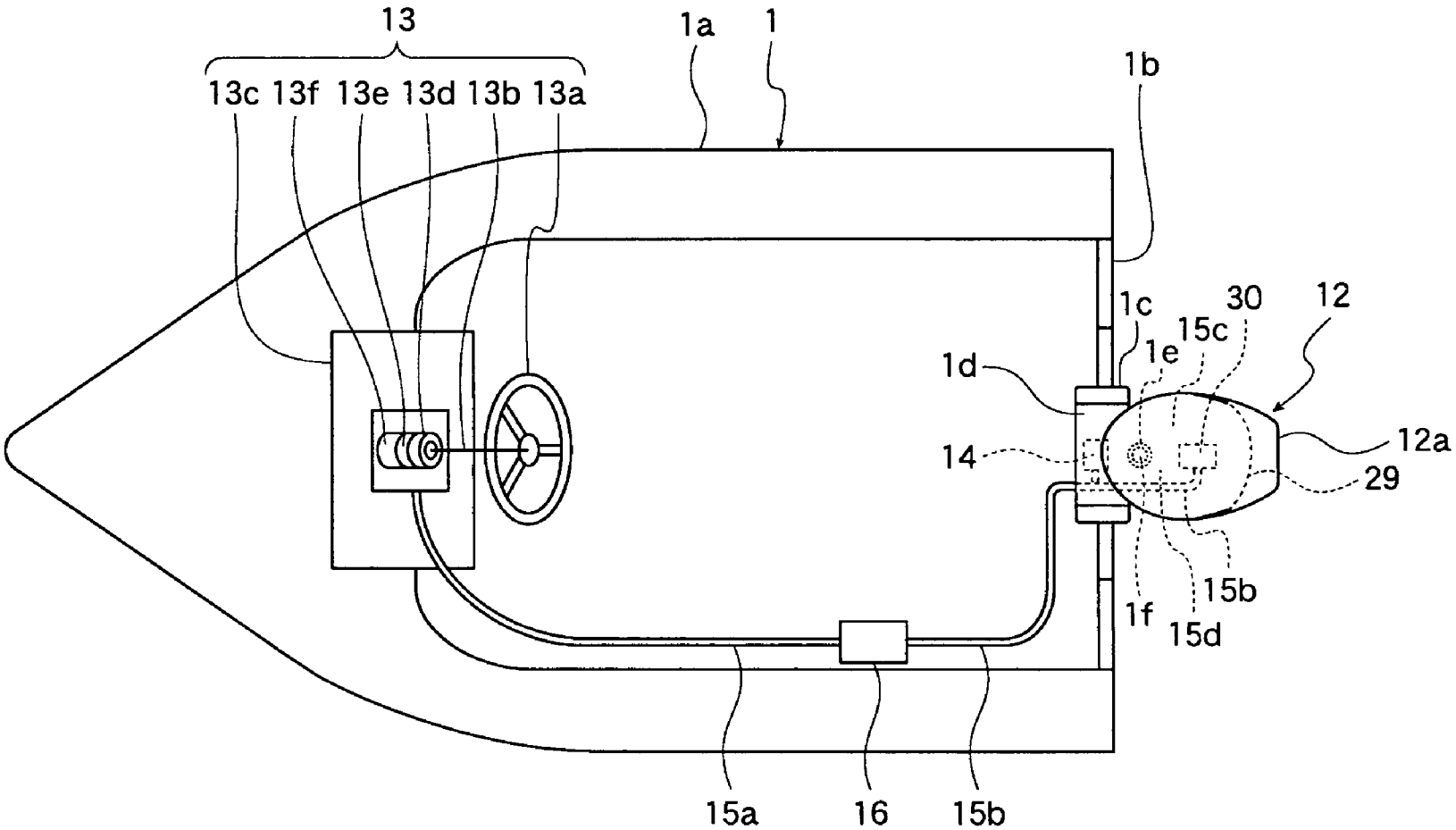
FIG. 1 is a schematic plan view of a boat according to a first preferred embodiment of the present invention.

Preferred embodiments of the present invention will be described below with reference to the accompanying drawings.

First Preferred Embodiment

FIGS. 1 to 5 show the first preferred embodiment of the present invention.

A boat 1 according to the first preferred embodiment includes an outboard motor 12 as an example of a boat propulsion unit provided at the stern of a hull 1*a* in a rotatable manner, and arranged such that a steering motor 14 steers the outboard motor 12 by the control of an operator of a steering device 13 as an example of a boat propulsion unit operation controller. The steering motor 14 and the steering device 13 are electrically connected by signal cables 15*a*, 15*d*. A steering controller 16 is arranged between the signal cables 15*a*, 15*d*, and the steering motor 14 is controlled by the steering controller 16.

The outboard motor 12 provides a propulsive force to the boat 1 via a propeller 27, and changes a traveling direction of the boat 1 at the same time. A trim tab 28 is disposed in the outboard motor 12.

An outboard motor body 12*a* of the outboard motor 12 internally houses an engine 29 that drives the propeller 27 for rotation. The outboard motor body 12*a* is attached to a transom plate 1*b* that defines a rear portion of the hull 1*a* through a clamp bracket 1*c* and a swivel bracket 1*d* mounted on the clamp bracket 1*c*. The swivel bracket 1*d* includes a swivel bearing 1*e* extending vertically with respect to the sheet surface of FIG. 1. A swivel shaft 1*f* is attached to the outboard motor body 12*a* in a way that it is rotatable around the swivel bearing 1*e*. The swivel shaft 1*f* is connected with a whirl mechanism (not shown), and arranged to steer the outboard motor 12 by driving the whirl mechanism with the steering motor 14.

The steering device 13 is preferably disposed in front of an operator's seat of the hull 1*a*, for example. A top end of a steering shaft 13*b* is connected to the center of a steering wheel 13*a* of the steering device 13, and a bottom end of the steering shaft 13*b* is inserted into a steering control section 13*c* and rotatably supported therein. In the steering control section 13*c*, a rotation sensor 13*d* that is arranged to detect a rotational speed and a rotational direction of the steering shaft 13*b*; an angle sensor 13*e* that is arranged to detect a rudder angle of the steering shaft 13*b*; a portion of a steering load detector 20 that is arranged to detect a steering direction, a control angle, and a control speed of the steering wheel 13*a*; and a reaction torque motor 13*f* that is arranged to provide tactile feedback to the steering wheel 13*a* are preferably arranged around the steering shaft 13*b*.

The steering control section 13*c* is connected to the steering controller 16 by the signal cable 15*a*, and the steering controller 16 is connected to an outboard motor side controller 30 disposed in the outboard motor body 12*a* by a signal cable 15*b*. The steering controller 16 may be arranged on a steering device 13 or an outboard motor side controller 30.

Figure 2:
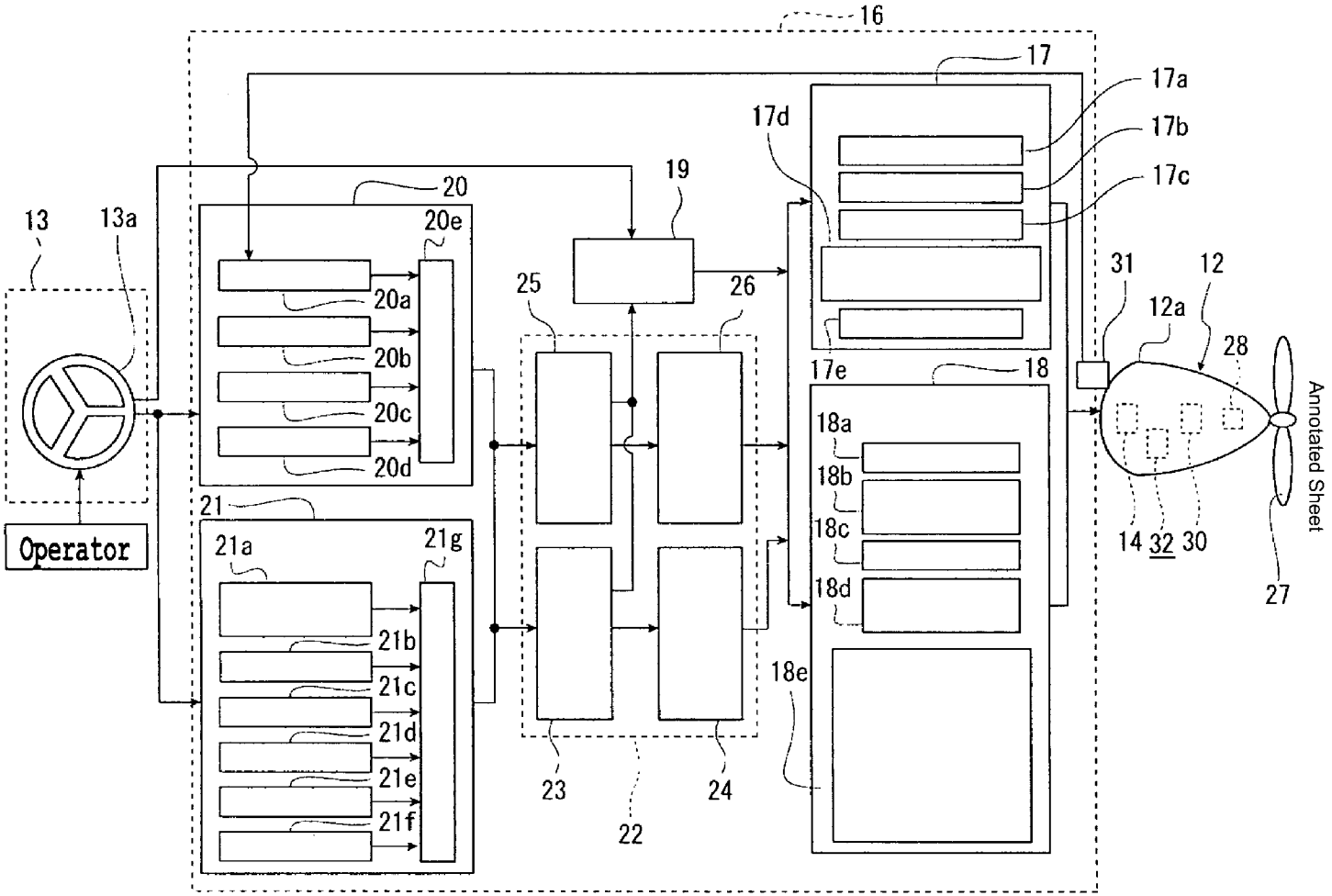
FIG. 2 is a functional block diagram according to the first preferred embodiment of the present invention.

The steering controller 16 is configured in a way that controls various devices based on an executable program. As shown in FIG. 2, the steering controller 16 preferably includes an electric power load controller 18, a normal time steering drive controller 19, a steering load detector 20, a motor output detector 21, and an emergency control unit 22. The emergency control unit 22 preferably includes a second prediction determination unit 23, a second emergency controller 24, a first prediction determination unit 25, and a first emergency controller 26.

The steering load detector 20 is preferably configured to calculate an output value of the steering motor 14 necessary for steering the outboard motor 12 in a traveling state. The motor output detector 21 is preferably configured to detect a possible output value that can be output by the steering motor 14 in the same traveling state.

The possible output value is calculated mainly based on a battery charge amount in consideration of an output reduction amount of the steering motor 14. The battery charge amount is detected from a voltage value of the battery, and output reduction of the steering motor 14 is caused, for example, by the temperature of the steering motor 14 or by deterioration due to long use. The output reduction amount is calculated by digitizing an incidence degree of those factors.

The second prediction determination unit 23 is preferably configured to compare a necessary output value from the steering load detector 20 with a possible output value from the motor output detector 21.

The electric power load controller 17 is preferably configured to perform a control operation such that, when the necessary output value is determined to be larger than the possible output value by the second prediction determination unit 23, the electric power to be supplied to the steering motor 14 is increased so as to be larger than a current state and a possible output value is increased (electric power is secured) through the second emergency controller 24.

The steering load controller 18 is preferably configured to perform a control operation such that, when the necessary output value is determined to be larger than the possible output value by the second prediction determination unit 23, a necessary output value is reduced to be less than a current state through the second emergency controller 24.

Furthermore, the first prediction determination unit 25 is configured in a way that compares an actual charge amount of the battery that supplies electric power to the steering motor 14 with a predetermined threshold value in accordance with a traveling state.

Instead of the actual charge amount, comparison may be made between a predicted battery charge amount calculated from a predicted electric current use and the threshold value.

That is, as for a predicted electric current use, a necessary output is calculated from a traveling state (engine rotational speed, boat traveling speed, etc.), and a necessary electric current is calculated on the basis of the result, then a remaining charge amount of the battery after a certain period of time (predicted charge amount) is calculated. Alternatively, a remaining charge amount of the battery after a certain period of time may be calculated on the basis of the change in the battery charge amount (voltage change in certain period of time, etc.).

The electric power load controller 17 is preferably configured to perform a control operation such that, when the threshold value is determined to be larger than the battery charge amount through the first prediction unit 25, electric power to be supplied to the steering motor 14 is increased so as to be larger than a current state and a possible output value is increased through the first emergency controller 26.

The steering load controller 18 is preferably configured to perform a control operation such that, when the threshold value is determined to be larger than the battery charge amount through the first prediction unit 25, a necessary output value is reduced to be less than a current state through the first emergency controller 26.

The electric power load controller 17 is preferably configured to control electric power supply to the steering motor 14 by an electric power control section 17*a* of the steering motor 14, control electric power supply to the engine starter 32 by an electric power control section 17*b* of the engine starter 32, control electric power supply to a trim device by an electric power control section 17*c* of the trim device, control a power generation amount of an engine driven generator (not shown) by an electric power control section 17*d* of the engine driven generator (not shown), and control the magnitude of the electric power load of other various electric apparatuses by an electric power control section 17*e* of other loads. Electric power control of the engine starter can also suppress electric power consumption by limiting the number of outboard motors that can drive the engine starter when multiple outboard motors are mounted.

The steering load controller 18 is preferably configured to control factors that influence the magnitude of a steering load (necessary output value). When a steering load is controlled to be small, the steering load controller 18 takes various actions to control a steering load of the outboard motor 12 (shown in FIG. 2), including trimming up by a trim control section 18*a*, reducing the boat speed and reducing the engine rotational speed by a boat speed and engine rotational speed control section 18*b*, limiting a rudder angle or increasing reactive force by a rudder angle limitation reactive force control section 18*c*, performing various control operations such as reducing a response level or changing the gain by a response level and gain control section 18*d*, and making corrections such as adjusting a transom height, changing an add-on cavitation plate, or adjusting a trim tab setting by a warning mismatch correcting section 18*e*. When a steering load needs to be reduced, the warning mismatch correcting section 18*e* can reduce a steering load (necessary output value) by instructing an operator to adjust a transom height, exchange an add-on cavitation plate, or adjust a trim tab setting.

The normal time steering drive controller 19 is preferably configured to control the steering motor 14 or the like based on the steering control of a boat propulsion unit operation controller 13 when a motor output is larger than a steering load and a battery charge amount is larger than a threshold value that is a minimum charge amount necessary for traveling. Specifically, the normal time steering drive controller 19 is preferably configured to control the steering motor 14 or the like by controlling the respective elements of the electric power load controller 17 and the steering load controller 18 based on motor characteristics and a torque amount necessary for steering the outboard motor 12, for example (step S9 in FIG. 3).

The steering load detector 20 is preferably configured to calculate a required necessary output value by detecting the respective states of control elements that are factors of a steering load. The steering load detector 20 is preferably configured to perform computation and calculating of a necessary output value in a necessary output calculation unit 20*e* based on the data detected by one or a plurality of a steering state detector 20*a*, a traveling state detector 20*b*, an outboard motor state detector 20*c*, and a motor state detector 20*d* (steps S1, S2 in FIG. 3).

The steering state detector 20*a* is preferably configured to detect a steering state by detecting the respective states of a rudder angle, speed, acceleration, and steering operation. The steering state detector 20*a* detects a steering state including a detection signal of a steering angle sensor 31 disposed in the vicinity of the outboard motor 12.

The traveling state detector 20*b* is preferably configured to detect a traveling state by comprehensively determining the respective states of speed and magnitude of engine rotational speed, magnitude of acceleration, thrust, a trim angle, weight, and the waterline.

The outboard motor state detector 20*c* is preferably configured to detect an outboard motor state by comprehensively determining the number of outboard motors, a mounting position, a propeller opening direction, a propeller shape, a trim tab setting, a height and length of transom, and the presence or absence of or a state of an add-on cavitation plate.

The motor state detector 20*d* is preferably configured to detect a motor state by comprehensively determining the respective states of responsiveness of the steering motor 14 determined by deviation and gain, the number of the steering motors 14 that are driven, temperature of the steering motor 14, temperature of the motor drive circuit, a fault or lock or a short circuit, and a battery voltage.

Figure 3:
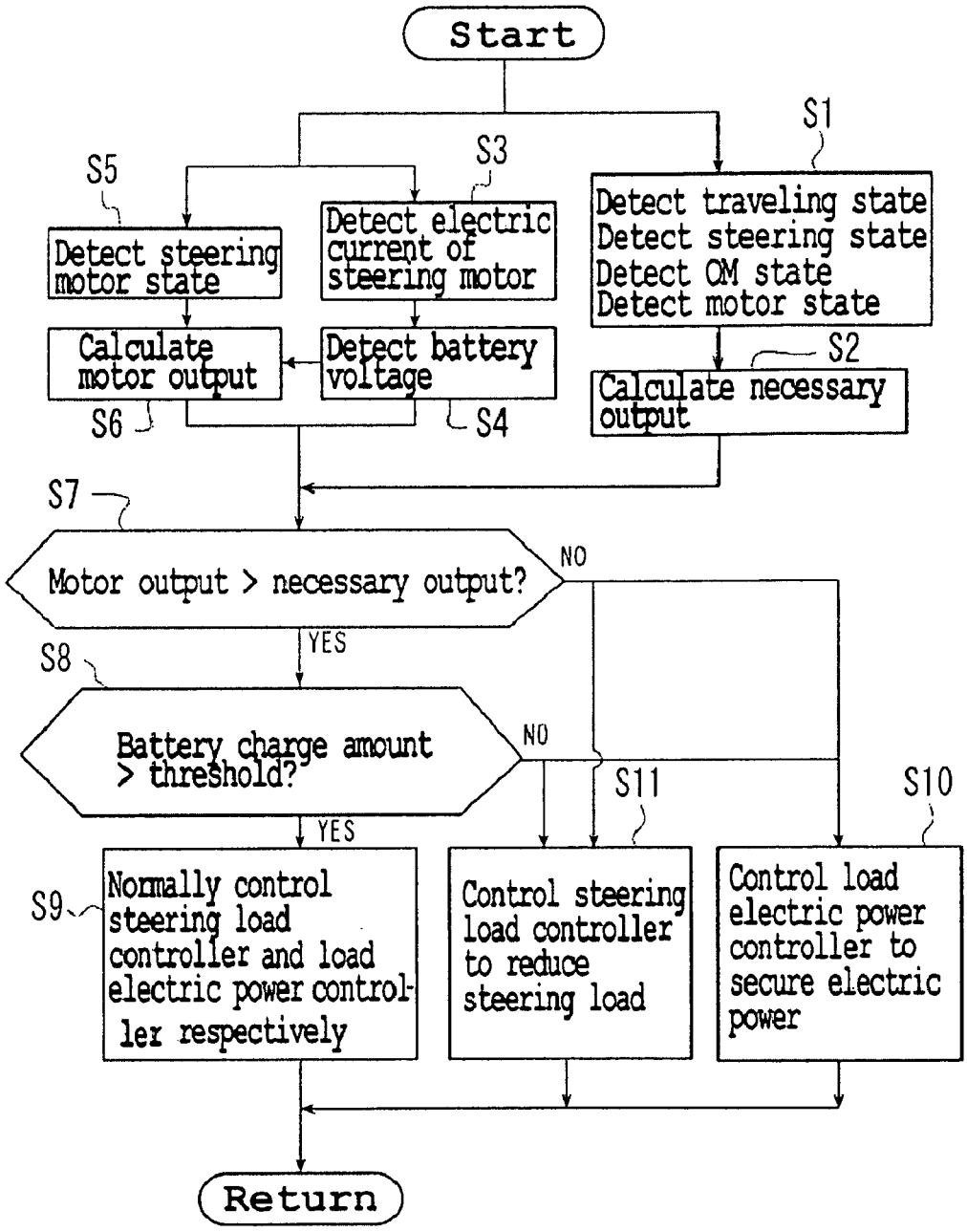
FIG. 3 is a flowchart showing specified procedures of steering according to the first preferred embodiment of the present invention.

The motor output detector 21 is preferably configured to compute and calculate an output of the steering motor 14 in an output calculation unit 21*g* based on the data detected by one or a plurality of a steering motor power supply state detector 21*a*, a motor quantity and motor driver temperature detector 21*b*, a battery voltage detector 21*c*, a steering motor electric current detector 21*d*, a control and gain detector 21*e*, and a motor-operated system state detector 21*f* arranged to detect the others (steps S3 to S6 in FIG. 3).

On the other hand, the second prediction determination unit 23 is preferably configured to predict whether a steering output is sufficient or not by comparing a steering load (necessary output value) detected and calculated by the steering load detector 20 with a possible output value detected and calculated by the motor output detector 21 (step S7 in FIG. 3).

The second emergency controller 24 is preferably configured to perform control to secure electric power (increase a possible output value) for the steering control of the steering motor 14 by reducing an electric power load of electric apparatuses excluding electric power used for the steering control of the steering motor 14 through the electric power load controller 17, and for performing control to reduce a steering load (reduce a necessary output value to be less than a current state) of the outboard motor 12 through the steering load controller 18, when the second prediction determination unit 23 predicts the insufficiency of steering control (steps S10, S11 in FIG. 3).

More specifically, the second emergency controller 24 is preferably configured to perform control to reduce the electric power load of various electric apparatuses such as the engine starter (not shown), the trim tab 28, and the engine driven generator (not shown) by the electric power load controller 17. At the same time, the second controller 24 performs control to reduce a steering load of the outboard motor 12 to be smaller than a motor output by the steering load controller 18 that implements the respective control units that are configured to perform a trim u control by the trim control section 18*a*, perform a speed reduction and engine rotational speed reduction control by the boat speed and engine rotational speed control section 18*b*, perform a control of rudder angle limitation and reactive force increase control by the rudder angle limitation reactive force control section 18*c*, perform a control of response level reduction and gain change by the response level and gain control section 18*d*, and correct a warning mismatch such as a transom height, an add-on cavitation plate, and a trim tab setting by the warning mismatch correcting section 18*e*.

The first prediction determination unit 25 is preferably configured to predict whether or not the battery charge amount is continued to be less than a threshold value after the second prediction determination unit 23 is determined not to predict the insufficiency of outboard motor output (S8 in FIG. 3).

The first emergency controller 26 is preferably configured to perform control to secure the electric power for the steering control of the steering motor 14 by reducing the electric power load of electric apparatuses excluding the electric power used for the steering control of the steering motor 14 through the electric power load controller 17, and to perform control to reduce a steering load of the outboard motor 12 (to reduce a necessary output value to be less than a current value) through the steering load controller 18, when the first prediction determination unit 25 predicts that the battery charge amount becomes less than a threshold value (steps S10, S11 in FIG. 3).

Now, functions will be described with reference to a flowchart shown in FIG. 3.

First, traveling state detection, steering state detection, outboard motor state (OM state) detection, and motor state detection are performed by the steering load detector 20 (step S1), then a necessary output value (steering load) for steering is calculated on the basis of the respective detected signals (step S2). Also, an electric current of the steering motor 14 and a battery voltage are detected by the motor output detector 21 (step S3 and step S4), and a state of the steering motor 14 is detected (step S5) at the same time, and the motor output is calculated from these detection results (step S6).

Next, the calculated motor output and steering load are input to the second prediction determination unit 23, the motor output is compared to the steering load and determined whether or not it is larger in the second prediction determination unit 23 (step S7), when the motor output is larger, it is determined to be "YES", the battery charge amount calculated by the battery voltage detection (step S4) is compared to a threshold value that is the minimum charge amount necessary for traveling, and determined whether it is larger or not (step S8), when it is larger, it is determined to be "YES"; and the normal time steering drive controller 19 performs normal control to the electric power load controller 17 and the steering load controller 18 (step S9).

That is, when the motor output is larger than a steering load and when the battery charge amount is larger than a threshold value that is a minimum charge amount necessary for traveling, normal steering drive control is performed with a larger motor output than a necessary steering load calculated by the steering load detector 20 based on the steering control of the boat propulsion unit operation controller 13.

In determination of the step S7, when a steering load is larger than the motor output, it is determined to be "NO", in the electric power load controller 17, electric power for controlling a steering load is secured by reducing the electric power load of electric apparatuses excluding the electric power used for the steering control in the electric power load controller 17 (step S10), and control for reducing a steering load is performed through the steering load controller 18 (step S11).

Figure 4:
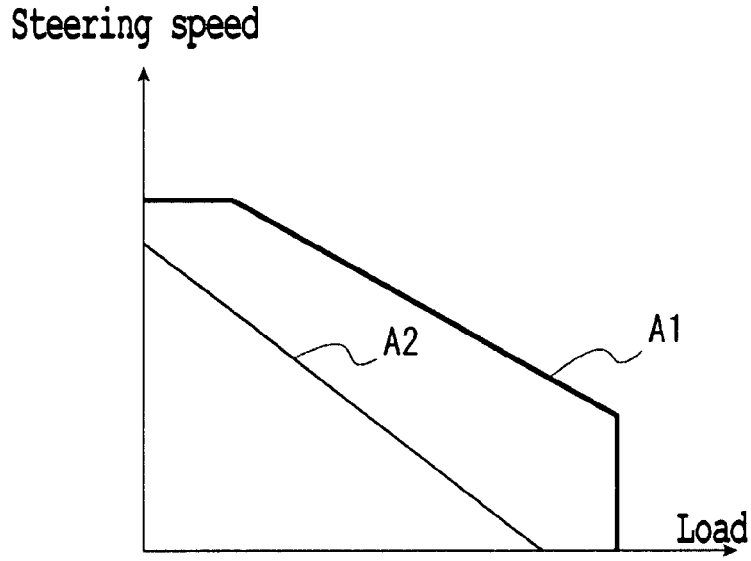
FIG. 4 is a graph chart showing a relationship between steering speed and a load according to the first preferred embodiment of the present invention.

As shown in FIG. 4, with respect to a set characteristic performance line A1, there is a case when a charged voltage is reduced, performance is lowered as shown by a characteristic line A2, and a possible output value on the characteristic line A2 may become less than a necessary output value (in the case of "NO" in step S7). In this case, a possible output value can be made larger than a necessary output value by securing the electric power by the electric power load controller 17 or the like.

In determination of the step S8, when the battery charge amount is less than a threshold value, it is determined to be "NO", then the process proceeds to step S10 and step S11, and the same control as described above is performed.

Figure 5:
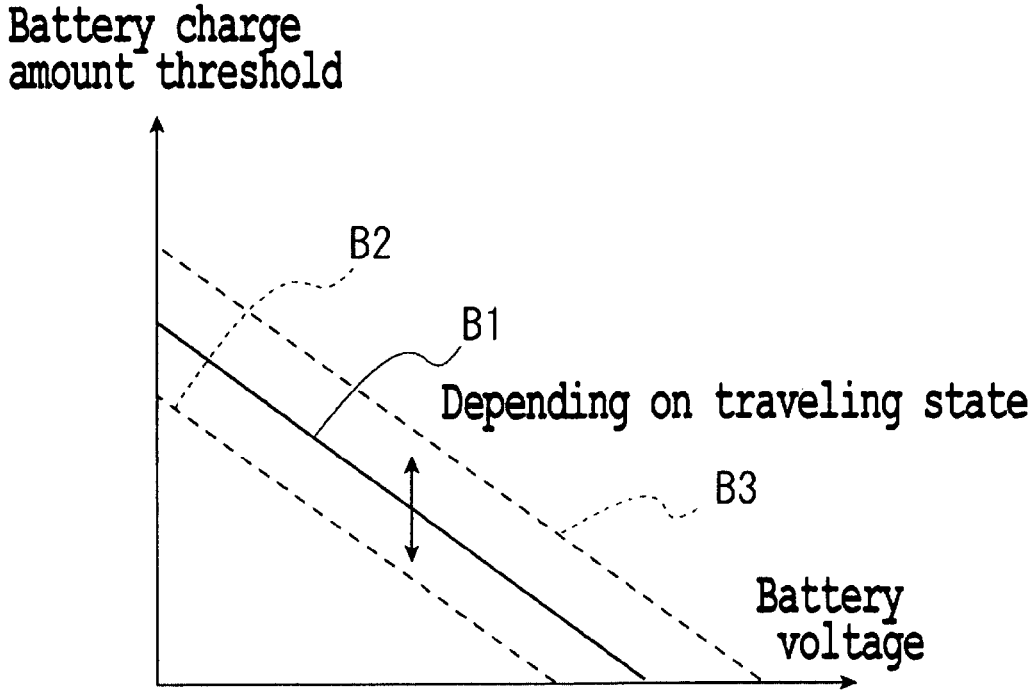
FIG. 5 is a graph chart showing a relationship between a reference electric current and a battery voltage according to the first preferred embodiment of the present invention.

By the way, as shown in FIG. 5, with respect to a characteristic line B1 shown in solid line in the drawing, there is a case that the characteristic line shifts to characteristic lines B2, B3 as shown in broken lines along with a change in the traveling state, and the battery charge amount becomes less than a threshold value. In this case, steering capability can be secured by controlling a steering load to be small by the steering load controller 18 or the like.

According to this preferred embodiment, by comparing a steering load detected by the steering load detector 20 with a motor output detected by the motor output detector 21, when the motor output to perform steering becomes less than a steering load as a result of a reduced battery charge amount, control is performed through the electric power load controller 17 and the steering load controller 18, so that steering control can be effectively performed while securing a propulsive force by maintaining a substantially uniform motor output.

Also, when the battery charge amount is less than a threshold value, control is performed through the electric power load controller 17 and the steering load controller 18 in the same way as described above, so that steering control can be preferably performed.

Furthermore, detection of a necessary output is calculated from any of a traveling state, a steering state, an outboard motor state, and a motor drive state, so that the necessary output for steering the steering motor 14 can be appropriately calculated. Control in response to a charge state is determined by comparing a threshold electric current set corresponding to a battery voltage with an actual electric current or a predicted electric current use, so that appropriate control corresponding to a charge state can be achieved.

The steering load controller 18 is preferably arranged to control any of trim, engine rotation, rudder angle, steering reactive force, motor-driven power supply, so that a steering load can be effectively reduced.

Furthermore, the electric power load controller 17 is preferably arranged to control at least any one of the number of outboard motors that is driven, drive of the trim tab 28, drive of the engine starter, engine rotational speed, the number of batteries that are connected, and the number of electric generators that are driven, and increases the electric power to be supplied to the steering motor larger than a current state to increase a possible output value. Thus, steering control can be effectively performed while continuously securing a propulsive force by maintaining a substantially uniform motor output more.

Second Preferred Embodiment

Figure 6:
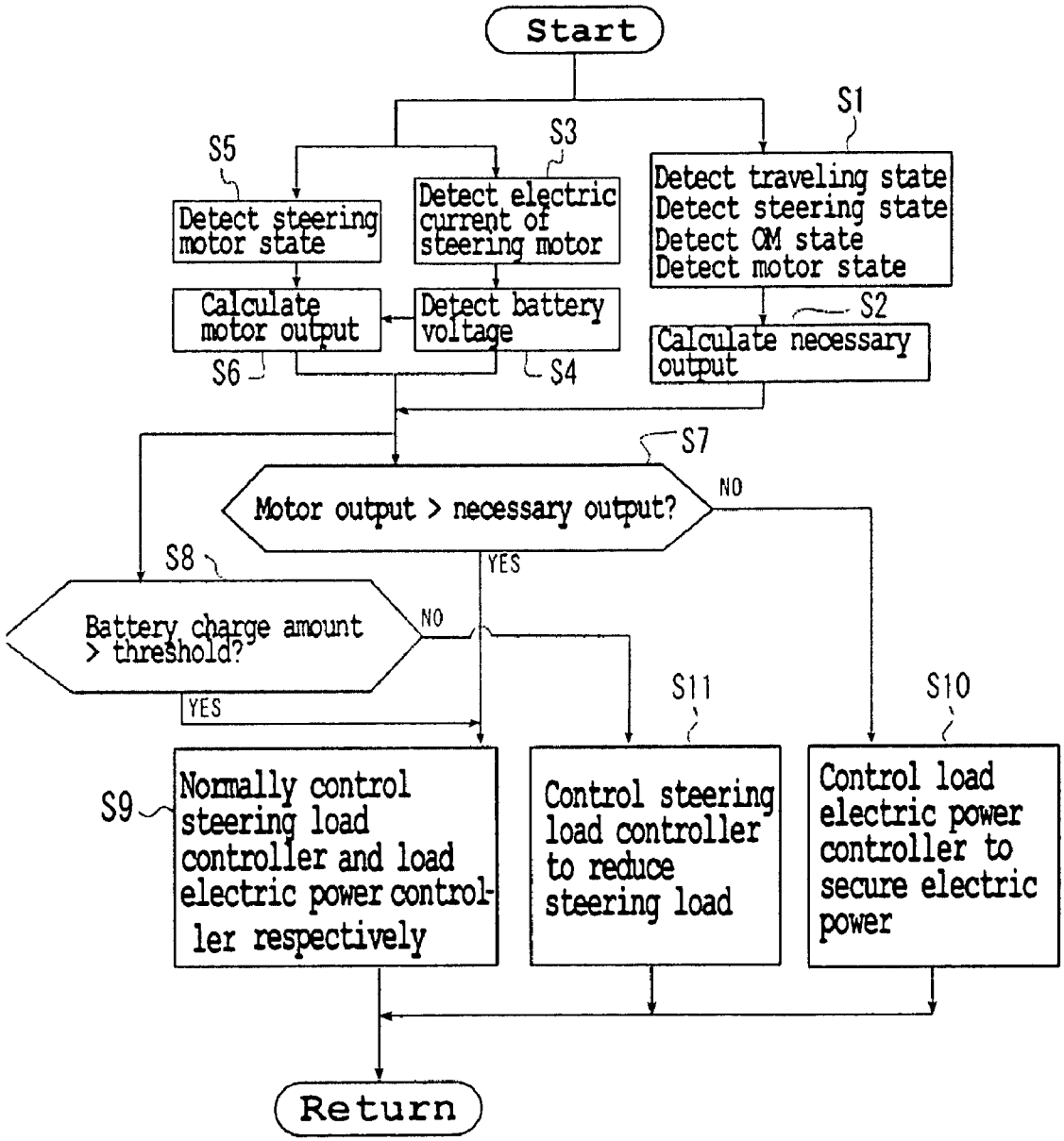
FIG. 6 is a flowchart corresponding to FIG. 3 of a second preferred embodiment of the present invention.

FIG. 6 shows the second preferred embodiment of the present invention.

The second preferred embodiment is different from the first preferred embodiment in the control method.

That is, in the second preferred embodiment, step S7 and step S8 shown in FIG. 3 in the first preferred embodiment, are preferably processed in parallel. In the case of a "NO" in step S7. That is, the process proceeds to step S10, and a charge amount is increased in order to secure electric power, or a load is reduced in order to secure motor output in the same way as the first preferred embodiment. In the case of "YES" in step S7, the process proceeds to step S9, and the same control as the first preferred embodiment is performed.

In the case of "NO" in step S8, the process proceeds to step S11, and a traveling limitation is performed in order to reduce a steering load in the same way as the first preferred embodiment. In the case of "YES" in step S8, the process proceeds to step S9, and the same control as the first preferred embodiment is performed.

In this way also, steering control can be effectively performed while continuously securing a propulsive force by maintaining a substantially uniform motor output.

Other configurations and functions are preferably the same as those of the first preferred embodiment, and hence their description is omitted.

The various preferred embodiments described above are examples of the present invention. The present invention is not limited to the preferred embodiments described above.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat comprising:

a boat propulsion unit mounted on a hull in a rotatable manner;

a boat propulsion unit operation controller disposed in the hull to be steered by an operator;

a steering motor to steer the boat propulsion unit based on steering control of the boat propulsion unit operation controller;

a signal cable to electrically connect the steering motor and the boat propulsion unit operation controller;

a steering load detector to calculate a necessary output value of the steering motor required to steer the boat propulsion unit in a traveling state;

a motor output detector to detect a possible output value that can be output by the steering motor;

a prediction determination unit to compare the necessary output value from the steering load detector with the possible output value from the motor output detector; and an electric power load controller to control a battery charge amount to be increased and/or to control an electric power load to be reduced when the necessary output value is determined to be larger than the possible output value by the prediction determination unit.

2. The boat according to claim 1, wherein the steering load detector calculates the necessary output value from at least either one of:

a traveling state including respective states of speed and magnitude of engine rotational speed, magnitude of acceleration, thrust, a trim angle, weight, and/or a waterline, a steering state including respective states of a rudder angle, speed, acceleration, or steering operation, a state of the boat propulsion unit including the number of outboard motors, a mounting position of the boat propulsion unit, a propeller opening direction, a propeller shape, a trim tab setting, a height and length of a transom of the boat, and/or the presence or absence of, or a state of, an add-on cavitation plate, or the steering motor drive state including responsiveness of the steering motor determined by deviation and gain, the number of the steering motors that are driven, temperature of the steering motor, temperature of a motor drive circuit for the steering motor, a fault or lock or a short circuit for the steering motor, and/or a voltage supplied to the steering motor from the battery.

3. The boat according to claim 1, wherein the motor output detector detects the possible output value from any one of a battery voltage, a battery current, a steering motor temperature, a steering motor fault state, or a number of boat propulsion units that are driven.

4. The boat according to claim 1, wherein the electric power load controller controls at least any one of a number of driven engines of the boat propulsion unit, driving of the trim, driving of an engine starter, engine rotational speed, a number of batteries that are connected, or a number of electric generators that are driven, and increases electric power to be supplied to the steering motor to be larger than a current state of electric power available to the steering motor, so that the possible output value is increased.

5. The boat according to claim 1, wherein the electric power load controller reduces the electric power load of electric apparatuses on the boat excluding electric power used by the steering motor, and to increase electric power to be supplied to the steering motor to be larger than a current state of electric power available to the steering motor, so that the possible output value is increased.

* * * * *